US007445516B2

(12) United States Patent
Chung et al.

(10) Patent No.: US 7,445,516 B2
(45) Date of Patent: Nov. 4, 2008

(54) AUDIO SIGNAL SWITCHER

(75) Inventors: Shin-Hong Chung, Shenzhen (CN); Xiao-Guang Li, Shenzhen (CN); Kuan-Hong Hsieh, Shenzhen (CN)

(73) Assignees: Ensky Technology (Shenzhen) Co., Ltd., Baoan District, Shenzhen, Guangdong Province (CN); Ensky Technology Co., Ltd., Pan Chiao, Taipei Hsien (TW)

( * ) Notice: Subject to any disclaimer, the term of this patent is extended or adjusted under 35 U.S.C. 154(b) by 0 days.

(21) Appl. No.: 11/960,734

(22) Filed: Dec. 20, 2007

(65) Prior Publication Data

US 2008/0153351 A1 Jun. 26, 2008

(30) Foreign Application Priority Data

Dec. 20, 2006 (CN) ..... 2006 1 0201337

(51) Int. Cl.
*H01R 24/04* (2006.01)

(52) U.S. Cl. ..... 439/668; 439/654; 439/669

(58) Field of Classification Search ..... 439/668, 439/669, 654, 188, 676, 638
See application file for complete search history.

(56) References Cited

U.S. PATENT DOCUMENTS

| | | | | |
|---|---|---|---|---|
| 6,203,344 | B1 * | 3/2001 | Ito | 439/218 |
| 6,626,706 | B2 * | 9/2003 | Siddiqui et al. | 439/668 |
| 6,659,805 | B2 * | 12/2003 | Siddiqui et al. | 439/668 |
| 6,964,586 | B2 * | 11/2005 | Siddiqui | 439/669 |
| 7,318,750 | B1 * | 1/2008 | Chacon et al. | 439/638 |
| 7,338,328 | B2 * | 3/2008 | Krieger et al. | 439/668 |

* cited by examiner

*Primary Examiner*—Briggitte R Hammond
(74) *Attorney, Agent, or Firm*—Winston Hsu

(57) ABSTRACT

The present invention provides an audio signal switcher including a jack switcher and a plug switcher. The jack switcher includes an audio jack and a first USB port. The audio jack includes a left track segment, a micro segment, a right track segment, and a ground segment, which are correspondingly coupled to a first data pin, a second data pin, a power pin and a ground pin of the first USB port. The plug switcher includes an audio plug and a second USB port. The audio plug includes a left track segment, a micro segment, a right track segment, and a ground segment, which are correspondingly coupled to a first data pin, a second data pin, a power pin and a ground pin of said second USB port. The jack switcher can be connected to the plug switcher by a USB cable.

9 Claims, 4 Drawing Sheets

AUDIO SIGNAL SWITCHER

BACKGROUND

1. Technical Field

The present invention relates to an audio signal switcher, particularly to an audio signal switcher with a USB cable.

2. Related Art

Nowadays, it is common for electronic devices with audio playing function to be configured with an earphone input connector. It is also common for electronic devices with storage function to be configured with a USB interface. Thus, if an electronic device includes both an audio playing function and a USB interface, the user of the electronic device may have to carry earphones and USB cables. Both of these cables must be long enough to facilitate users sizes and desires. However, if the length of the cables is too long, the cables may become somewhat cumbersome and tend to tangle. Furthermore, it is troublesome for a user to carry many long cables.

Accordingly, it would be advantageous if the electronic device uses shorter cables with multiple uses. A USB cable can be used to transmit data between the electronic device and the storage device, and also used as an extension to the earphone cable. Thus the earphones and USB cables can be shorter. Shorter cables facilitate ease of use, a neat appearance when packaged, and easy carrying.

SUMMARY

An audio signal switcher includes a jack switcher and a plug switcher. The jack switcher includes an audio jack and a first USB port. The audio jack includes a left track segment, a micro segment, a right track segment, and a ground segment, which are correspondingly coupled to a first data pin, a second data pin, a power pin and a ground pin of the first USB port. The plug switcher includes an audio plug and a second USB port. The audio plug includes a left track segment, a micro segment, a right track segment, and a ground segment, which are correspondingly coupled to a first data pin, a second data pin, a power pin and a ground pin of said second USB port. The jack switcher can be connected to the plug switcher by a USB cable.

DETAILED DESCRIPTION OF THE EMBODIMENTS

Figure 1:
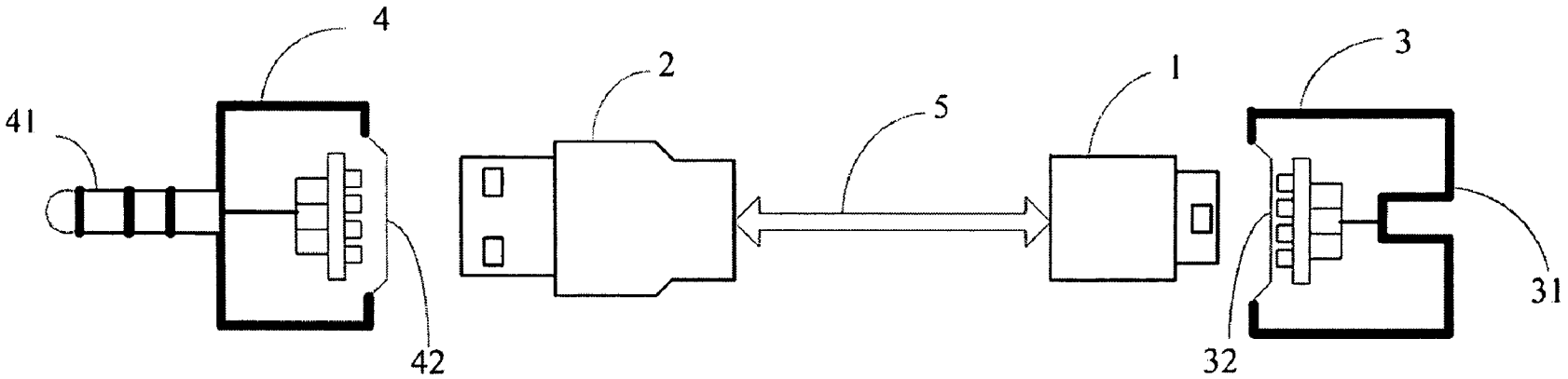
FIG. 1 shows a schematic diagram of an audio signal switcher according to a first embodiment, the audio signal switcher being connected with a USB cable.

FIG. 1 shows a schematic diagram of an audio signal switcher with a USB cable according to a first embodiment. The audio signal switcher includes a jack switcher 3 and a plug switcher 4 provided for connecting USB connectors at respective end of a USB cable 5. The USB connectors at respective end of the USB cable 5 are referred to as a first USB connector 1 and a second USB connector 2.

The jack switcher 3 includes an audio jack 31 and a first USB port 32. The audio jack 31 is a standard 3.5 mm audio jack, which is used for connecting with audio output devices such as an earphone. An inner structure of the jack switcher 3 will be described below with reference to FIG. 2.

The plug switcher 4 includes an audio plug 41 and a second USB port 42. The audio plug 41 is a standard 3.5 mm audio plug, which is used for connecting with an audio jack of a MP3 player, a computer or any other electronic device. An inner structure of the plug switcher 4 will be described below with reference to FIG. 3.

Figure 2:
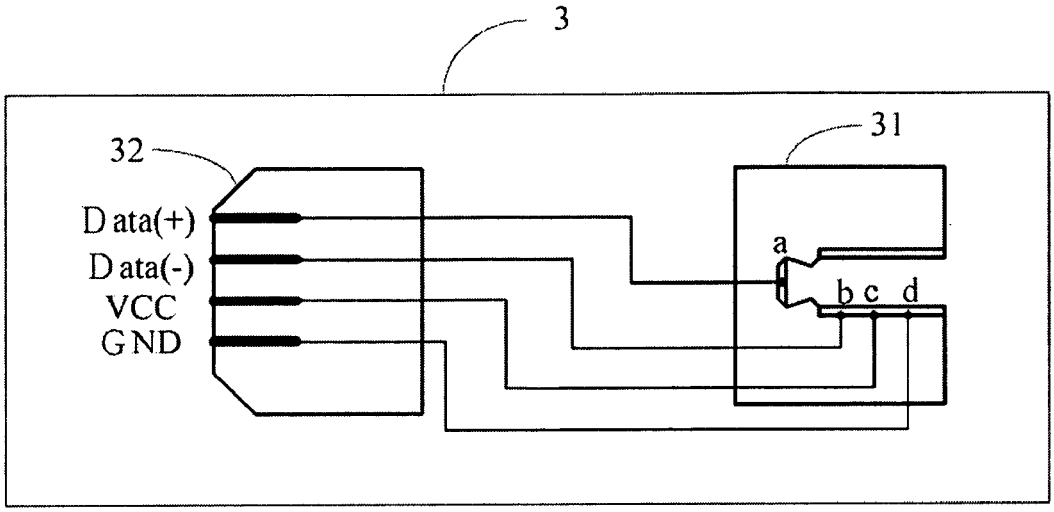
FIG. 2 is an inner electrical connection diagram of a jack switcher of the audio signal switcher of FIG. 1.

FIG. 2 is an inner electrical connection diagram of the jack switcher 3. The audio jack 31 is used for receiving a standard audio plug and includes four electrical parts: a left track segment "a", a micro segment "b", a right track segment "c" and a ground segment "d", each of which is electrically isolated from the others. The four electrical parts are correspondingly coupled to a first data pin (Data+), a second data pin (Data−), a power pin (VCC) and a ground pin (GND) of the first USB port 32.

Figure 3:
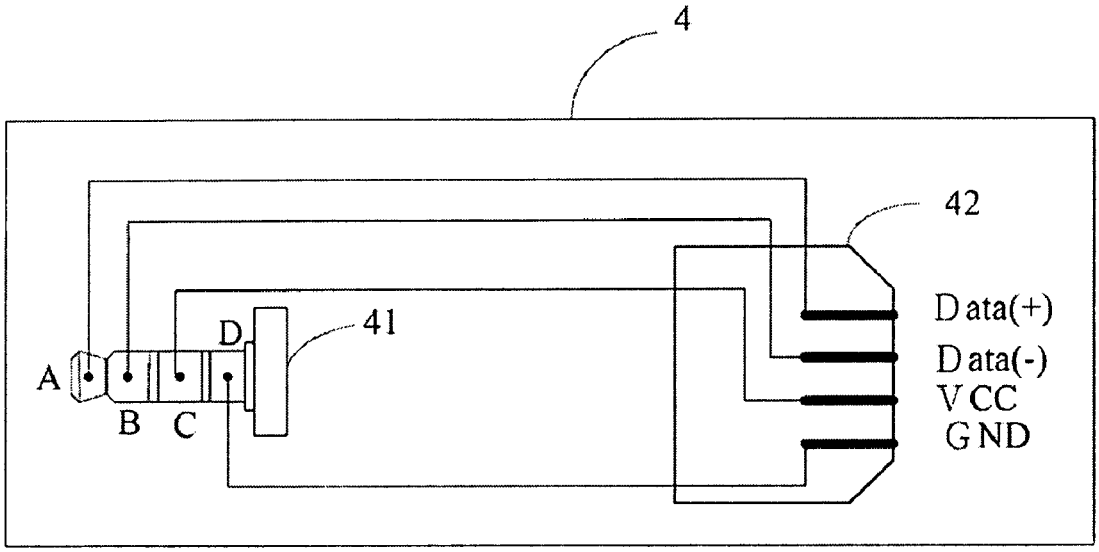
FIG. 3 is an inner electrical connection diagram of a plug switcher of the audio signal switcher of FIG. 1.

FIG. 3 is an inner electrical connection diagram of the plug switcher 4. The audio plug 41 includes four electrical parts: a left track segment "A", a micro segment "B", a right track input segment "C" and a ground segment "D", each of which is electrically isolated from the others. The four electrical parts are correspondingly coupled to a first data pin (Data+), a second data pin (Data−), a power pin (VCC) and a ground pin (GND) of the second USB port 42.

The electrical connections inside of the jack switcher 3 and the plug switcher 4 are not limited to the means introduced in FIG. 2 and FIG. 3. For example, alternatively, the left track segment "a" of the audio jack 42 can be connected to the second data pin (Data−) of the of the USB port 32, and the right track segment "c" can be connected to the first data pin (Data−) of the first USB port 32. Correspondingly, the left track segment "A" of the audio plug 41 can be connected to the second data pin (Data−) of the second USB port 42, and the right track segment "C" can be connected to the first data input pin (Data+) of the second USB port 42.

In the following, three applications of the audio signal switcher are detail described.

The audio plug 41 of the plug switcher 4 is inserted into the audio jack of an MP3 or another electronic device. The second USB port 42 is a standard female connector and the second connector 2 is a standard male connector. The second USB port 42 is coupled to the second connector 2. The first USB port 32 is a standard male connector and the first connector 1 is a standard female connector. The first USB port 32 is coupled to the first connector 1. The audio jack 31 receives an audio plug of an audio output device such as an earphone. The audio signal from the MP3 or other electronic device is transmitted via the audio plug 41, the second USB port 42, the USB cable 5, the first USB port 32, and the second audio jack 31 in turn before outputted by the audio output device.

Different from the first application, in the second application, the second USB port 42 is a standard male connector and the second connector 2 is a standard female connector. The first USB port 32 is a standard female connector and the first connector 1 is a standard male connector.

In the third application the MP3 or another electronic device is assumed to include a USB port. The second USB connector 2 is directly coupled with the USB port of the MP3 or other electronic devices, and the first USB connector 1 is coupled with the first USB port 32. The audio signal outputted by the MP3 or other electronic devices is transmitted via the USB cable 5 and the second connector 2 to the audio output device.

Figure 4:
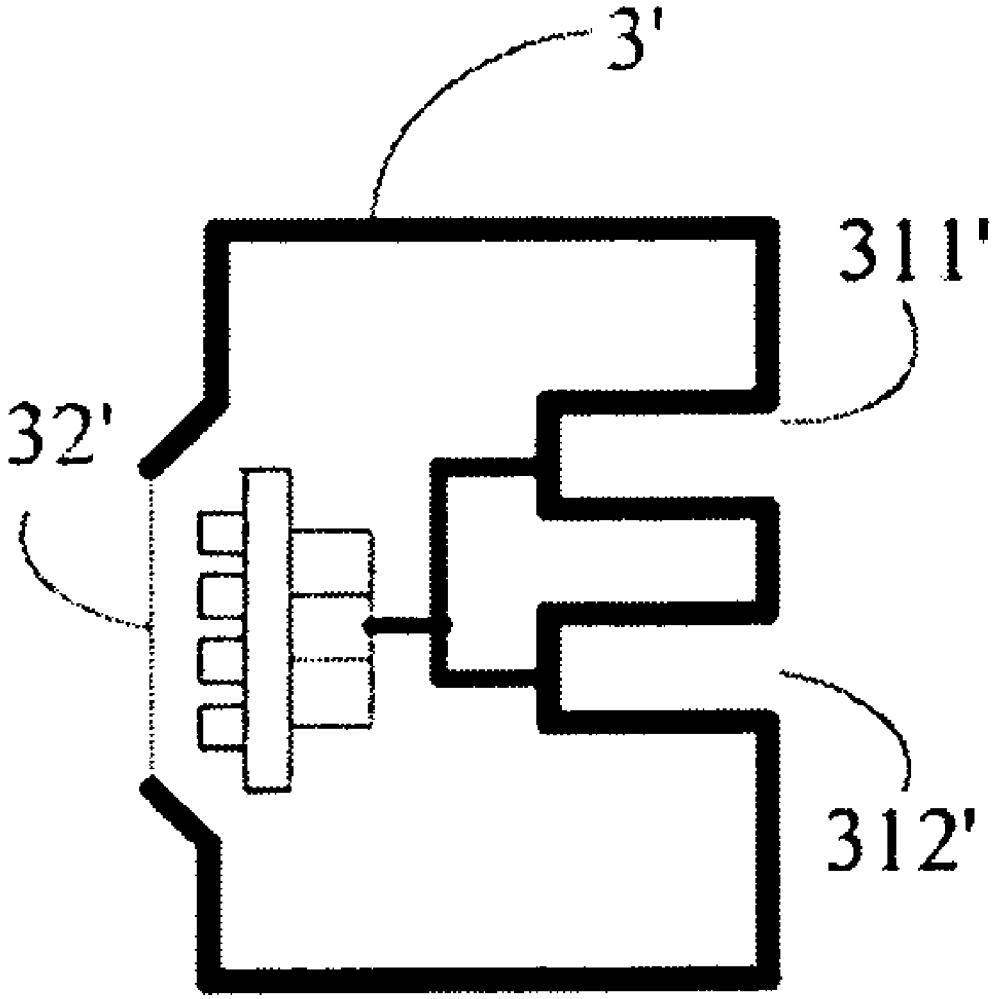
FIG. 4 is a schematic diagram of a jack switcher according to a second embodiment.

FIG. 4 shows a schematic diagram of a jack switcher of a second embodiment. Different from the first embodiment, in the second embodiment, a jack switcher 3' including two parallel audio jacks 311' and 312' is introduced. The two audio jacks 311' and 312' are both connected to a first USB port 32' and are provided for receiving two audio plugs of audio output devices, so that the audio signals from the MP3 or another electronic device can be outputted by the audio output device simultaneously. Similarly, in other cases, the jack switcher 3' can also be configured with more than two parallel audio jacks, such that the audio signals can be outputted by more than two audio output devices simultaneously.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An audio signal switcher comprising:

a jack switcher comprising an audio jack and a first USB port; said audio jack comprising a left track segment, a micro segment, a right track segment, and a ground segment, which are correspondingly coupled to a first data pin, a second data pin, a power pin and a ground pin of said first USB port.

2. The audio signal switcher according to claim 1, wherein said first USB port is a standard male connector for coupling to a first connector of a USB cable; said first connector is a standard female connector for coupling to said first USB port.

3. The audio signal switcher according to claim 1, wherein said first USB port is a standard female connector for coupling to a first connector of a USB cable; said first connector is a standard male connector for coupling to said first USB port.

4. The audio signal switcher according to claim 1, wherein said audio jack is a standard 3.5 mm audio jack.

5. The audio signal switcher according to claim 1, further comprising a plug switcher, said plug switcher comprising an audio plug and a second USB port; said audio plug comprising a left track segment, a micro segment, a right track segment, and a ground input, which are correspondingly coupled to a first data pin, a second data pin, a power pin and a ground pin of said second USB port; said plug switcher can be connected to said jack switcher by a USB cable.

6. The audio signal switcher according to claim 5, wherein said second USB port is a standard male connector for coupling to a second connector of a USB cable; said second connector is a standard female connector for coupling to said second USB port.

7. The audio signal switcher according to claim 5, wherein said second USB port is a standard female connector for coupling to a second connector of a USB cable; said second USB port is a standard male connector for coupling to a second connector of a USB cable.

8. The audio signal switcher according to claim 5, wherein said audio plug is a standard 3.5 mm audio plug.

9. The audio signal switcher according to claim 1, wherein the jack switcher comprises two or more audio jacks, said two or more audio jacks are parallel connected to the first USB port.

* * * * *